US005502554A

United States Patent [19]

Hayashi et al.

[11] Patent Number: 5,502,554

[45] Date of Patent: Mar. 26, 1996

[54] IMAGE TRANSFERRING UNIT OF NON-CONTACT TYPE ROLLER METHOD

[75] Inventors: Shigeki Hayashi; Hiroyuki Ueda; Tadakazu Ogiri; Shinichi Kotera; Hiroki Morishita; Yasuhiko Moriuchi; Kohichi Yasuda; Naoyuki Ishida, all of Osaka, Japan

[73] Assignee: Mita Industrial Co., Ltd., Japan

[21] Appl. No.: 323,934

[22] Filed: Oct. 17, 1994

[30] Foreign Application Priority Data

Nov. 16, 1993 [JP] Japan ..... 5-286346

[51] Int. Cl.[6] ..... G03G 15/16

[52] U.S. Cl. ..... 355/271; 271/308; 355/317

[58] Field of Search ..... 355/274, 271, 355/275, 277, 219, 208, 309, 315, 317; 361/225; 271/307, 308

[56] References Cited

U.S. PATENT DOCUMENTS

| | | | |
|---|---|---|---|
| 4,431,301 | 2/1984 | Hashimoto et al. | 355/274 |
| 4,766,459 | 8/1988 | Jinbo et al. | 355/315 |
| 4,908,674 | 3/1990 | Fukano et al. | 355/318 |
| 4,943,863 | 7/1990 | Ainoya | 355/271 |
| 5,138,374 | 8/1992 | Bellis | 355/200 |
| 5,189,469 | 2/1993 | Endo | 355/200 |
| 5,276,489 | 1/1994 | Kikuchi et al. | 355/274 |
| 5,345,299 | 9/1994 | Hashizume et al. | 355/274 |

FOREIGN PATENT DOCUMENTS

| | | | |
|---|---|---|---|
| 0147152 | 11/1981 | Japan | 355/276 |

*Primary Examiner*—A. T. Grimley
*Assistant Examiner*—Thu Dang
*Attorney, Agent, or Firm*—Beveridge, DeGrandi, Weilacher & Young

[57] ABSTRACT

In a transfer unit of a non-contact roller transfer method, both ends of a transfer roller shaft are supported independently of each other so as to be movable upward and downward, and an upward pushing force is provided thereto. A gap maintaining roller provided in the vicinity of each end portion of the transfer roller shaft is always in contact with the surface of a photoreceptor drum so that the gap between the surface of the photoreceptor drum and the transfer roller is maintained uniform and fixed. Further, both ends of a pre-transfer guide for guiding the sheet to the photoreceptor drum are supported in a manner such that the movement of each end accords with the movement of the end portion of the transfer roller, so that the distance between the photoreceptor drum and the pre-transfer guide is maintained uniform and fixed.

4 Claims, 5 Drawing Sheets

IMAGE TRANSFERRING UNIT OF NON-CONTACT TYPE ROLLER METHOD

BACKGROUND OF THE INVENTION

1. Field of the Invention

The present invention relates to an image forming apparatus such as an electrophotographic copying machine, a laser printer and a facsimile apparatus, or more particularly, to an improvement of a transfer unit employing a roller transfer method for transferring a toner image formed on the surface of a photoreceptor drum onto a sheet of paper.

2. Description of the Prior Art

In a transfer unit of a roller transfer method which is widely used in an image forming apparatus such as a copying machine, a conductive transfer roller is rotatively in contact with the surface of a photoreceptor drum carrying a toner image on its surface and rotating in one direction, so that a copy sheet is pressed against the toner on the drum surface. Then, a voltage reverse to that of the toner is applied to the transfer roller to transfer the toner image formed on the drum surface onto the sheet.

In a conventional transfer unit employing the roller transfer method, however, since the transfer roller is directly in contact with the drum surface when no sheet is present therebetween, residual toner on the drum surface adheres to the periphery of the transfer roller. Therefore, in the conventional transfer unit, a means is required for cleaning the transfer roller. Further, when the peripheral surface of the transfer roller is not in contact with the drum surface at a uniform and appropriate pressure, there is a non-uniformity in the image transferred to the sheet.

To solve such problems, a non-contact roller transfer method as shown in FIGS. 1 and 2 has been developed. In the transfer unit shown in these figures, a gap maintaining roller 33 having a diameter greater than that of a transfer roller 31 is attached to each end of a roller shaft 32 to which the transfer roller 31 is attached, and the peripheral surface of the gap maintaining roller 33 is in contact with the surface of a photoreceptor drum 34 so that a predetermined gap C is left between the peripheral surface of the transfer roller 31 and the drum surface.

With this arrangement, since the transfer roller 31 faces the drum 34 without being in contact therewith, the residual toner does not adhere to the peripheral surface of the transfer roller 31 and no cleaning means is necessary. Further, since the gap C between the drum surface and the peripheral surface of the transfer roller 31 is always maintained uniform by the gap maintaining roller 33, the generation of the image non-uniformity is restrained.

The arrangement of the transfer unit will be described in detail. Each of the front and rear ends of the roller shaft 32 to which the transfer roller 31 and the gap maintaining roller 33 are attached are rotatably supported by a bearing member 36. The roller shaft 32 is arranged to be parallel to the shaft of the photoreceptor drum 34. The bearing members 36 are each fixed by a screw 38 to an bearing attacher 37 arranged along the roller shaft 32. The bearing attacher 37 is supported to be swingable upward and downward by a shaft 39 arranged between side plates provided at the front and rear of the machine body. The bearing attacher 37 is pushed up by a spring 40 provided between the bearing attacher 37 and the base of the machine body. By this pushing force, the peripheral surfaces of the front and rear gap maintaining rollers 33 are brought into contact with the surface of the photoreceptor drum 34.

In the upstream side of the sheet conveying path in the vicinity of the transfer roller 31, a pre-transfer guide 35 is arranged for guiding the sheet to the drum 34. The pre-transfer guide 35 has a guide plate **35*a* being longer along the width of the machine body and ascending from the upstream side to the downstream side of the sheet conveying path. A bracket 35*b* provided to each end of the guide plate 35*a* is supported to be swingable upward and downward by a shaft 41 arranged between the front and rear side plates of the machine body, and is pushed up by a spring 42 provided between the bracket 35*b*** and the base of the machine body.

At the bearing member 36, another bearing portion **36*b* is formed at a position closer to the front end than a transfer roller bearing portion 36*a*. Between the front and rear bearing portions 36*b*, a small-diameter pre-transfer roller 43 is arranged. The upper surface of the guide plate 35*a* of the transfer guide 35 is substantially in contact with the pre-transfer roller 43**.

A sheet conveyed to the upper surface of the pre-transfer guide 35 is brought into contact with the drum surface with its conveying speed being maintained constant by the pre-transfer roller 43, and advances into the gap C. At this time, the sheet adheres to the surface of the drum 34 mainly by the resiliency of the sheet itself. When the sheet passes through the gap C between the transfer roller 31 and the photoreceptor drum 34, a voltage is applied to the transfer roller 31, so that the toner image is transferred from the drum 34 to the sheet.

In transfer units employing the non-contact type roller transfer method, the transfer efficiency varies according to the distance between the transfer roller 31 to which the voltage is applied and the surface of the photoreceptor drum 34 which carries a toner image thereon. The distance between the transfer roller 31 and the photoreceptor drum 34 is determined in consideration of this efficiency, and the applied voltage is set to be optimum in accordance therewith. In addition, the diameters of the front and rear gap maintaining rollers 33 are the same, and the distance between the transfer roller 31 and the drum 34 are uniform along the width of the machine body, i.e. along the length of the roller shaft 32.

The toner transfer efficiency further depends on how closely the sheet and the photoreceptor drum 34 are in contact. For this reason, in order that the force which presses the sheet against the photoreceptor drum 34 is uniform along the width of the machine body, the pre-transfer guide 35 is arranged so that the distance between the upper end of the guide plate **35*a* and the drum 34** is uniform. With this arrangement, the toner image is transferred without any non-uniformity along the width of the machine body.

However, in the transfer unit of the above structure, since the roller shaft 32 is supported at its both ends by the bearing attacher 37 supported by the shaft 39 arranged between the front and rear side plates of the machine body, when the base or the frame of the machine body is distorted, the roller shaft 32 may not be parallel to the shaft of the photoreceptor drum 34 any more. When the roller shaft 32 is not parallel to the shaft of the photoreceptor drum 34, only one of the gap maintaining rollers 33, which are attached in the vicinity of the both ends of the roller shaft 32, is in contact with the drum 34, so that it is impossible to maintain the gap C between the transfer roller 31 and the photoreceptor drum 34 to be uniform along the shaft of the drum 34. When the gap C is not uniform, the transfer efficiency is not uniform, so that there is a non-uniformity in the transferred image.

In addition, since the pre-transfer guide 35 is supported by the shaft 41 arranged between the side plates of the machine body, when the base or the frame of the machine body is distorted, the distance between the upper end of the guide plate 35*a* and the photoreceptor drum 34 is not uniform. Since the sheet is in close contact with the drum surface mainly because of its own resiliency as described previously, the closeness of the contact of the sheet with the drum surface varies with the variation in the distance between the guide plate 35*a* and the drum 34. Since the toner transfer efficiency also varies according to the closeness, the position shift of the pretransfer guide 35 makes uniform image transfer impossible.

The distortion of the machine body which exerts such bad influences may be caused not only by a great external shock but also by the unevenness of the floor on which the machine is placed. Therefore, it is desirable for the transfer roller and the pretransfer guide to be located always at uniform and fixed distances from the photoreceptor drum whether the machine body is distorted or not.

SUMMARY OF THE INVENTION

An object of the present invention is to always maintain uniform and fixed the gap between the surface of the photoreceptor drum and the transfer roller and the distance between the surface of the photoreceptor drum and the pre-transfer guide whether the base or the frame of the machine body is distorted or not.

A transfer unit of the non-contact roller transfer method according to the present invention is for use in an image forming apparatus where the peripheral surface of a transfer roller faces the surface of a photoreceptor drum with a predetermined gap between, and a pre-transfer guide for guiding a sheet to the surface of the photoreceptor drum is arranged in the upstream side of the transfer roller.

To achieve the above-mentioned object, according to the present invention, a pair of guide attaching members are provided for supporting the front and rear ends of the pretransfer guide. The guide attaching members are arranged independently of each other so as to be slidable upward and downward, and the position of the upper end of each guide attaching member varies with the variation in position of the gap maintaining means for maintaining the gap between the surface of the photoreceptor drum and the peripheral surface of the transfer roller.

With these features, since the front and rear guide attaching members slide independently of each other in response to the variation in positions of the gap maintaining means for maintaining the gap between the photoreceptor drum and the transfer roller, the distance between a guide plate of the pretransfer guide and the surface of the photoreceptor drum is always stable whether the machine body is distorted or not.

Further, according to the present invention, the transfer roller and the pre-transfer guide are arranged to be parallel to the photoreceptor drum, and the roller shaft of the transfer roller and the both end portions of the pre-transfer guide are supported independently at the front and at the rear. In addition, the bearing member and the guide attaching member of each of the front and rear supporting structures are arranged to be movable upward and downward, and are provided with an upward pushing force. At the front and rear ends of the transfer roller, the gap maintaining rollers are arranged having the same diameter which is greater than the diameter of the transfer roller.

The guide attaching member is always in contact with a part of the bearing member by the upward pushing force. Alternatively, the guide attaching member and the bearing member are fixed to each other so that the guide attaching member and the bearing member integrally move upward and downward.

With these features, the transfer roller shaft is pushed up independently at the front and at the rear by the pushing force, so that the front and rear gap maintaining rollers are in contact with the drum surface. Since the diameters of the front and rear gap maintaining rollers are the same, the gap between the transfer roller and the surface of the photoreceptor drum is uniform along the roller shaft. Even if the base or the frame of the machine body is distorted for some reason, since the front and rear end portions of the transfer roller shaft are independently supported and pushed up, the front and rear gap maintaining rollers are both in contact with the drum surface. As a result, the gap between the transfer roller and the photoreceptor drum is always maintained uniform and fixed. In addition, the positions of the front and rear bearing members of the transfer roller shaft are fixed relative to the photoreceptor drum.

In the arrangement where the guide attaching member abuts the bearing member, the pre-transfer guide is pushed up by the pushing force independently at the front and at the rear, and the front and rear guide attaching members stop by abutting the front and rear bearing members. Since the positions of the front and rear bearing members are always fixed relative to the photoreceptor drum as mentioned above, the positions of the front and rear guide attaching members are always fixed relative to the photoreceptor drum. As a result, even if the base or the frame of the machine body is distorted, the distance between the pre-transfer guide and the surface of the photoreceptor drum is maintained uniform and fixed.

Further, in the arrangement where the guide attaching member and the bearing member are fixed to each other so as to move integrally, since the positions of the front and rear bearing members are fixed relative to the photoreceptor drum, the positions of the front and rear guide attaching members are naturally fixed relative to the photoreceptor drum. As a result, the distance between the pre-transfer guide and the surface of the photoreceptor drum is maintained uniform and fixed.

According to the present invention, the positional relationship between the pre-transfer guide and the photoreceptor drum is maintained with the following specific arrangement: at both ends of the roller shaft, a pair of bearing members for supporting both ends of the roller shaft are arranged and supported by a pair of bearing attachers fixed to the machine body while being elastically pushed upward, and a pair of guide attaching members for supporting both ends of the pre-transfer guide are attached to the bearing attachers to be slidable upward and downward while being elastically pushed upward. Each guide attaching member is engaged with a corresponding bearing member so that its position varies with the variation in position of the bearing member.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
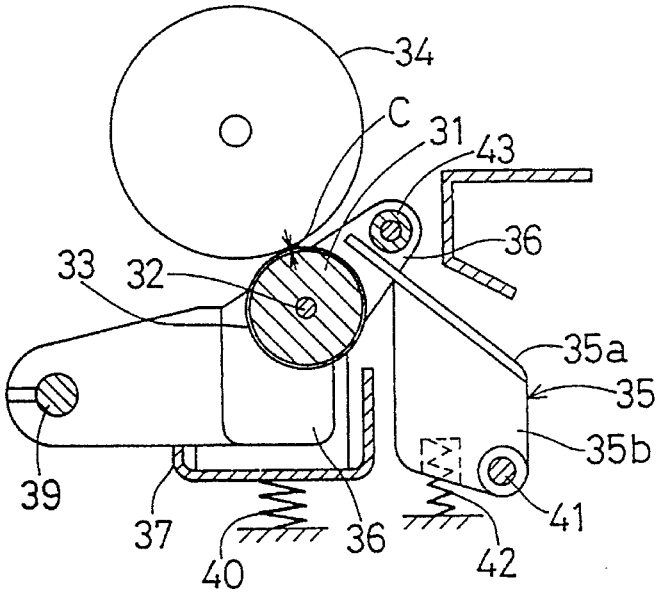
Fig. 1 Prior Art
FIG. 1 is a longitudinal cross-sectional view of a conventional transfer unit.
Figure 2:
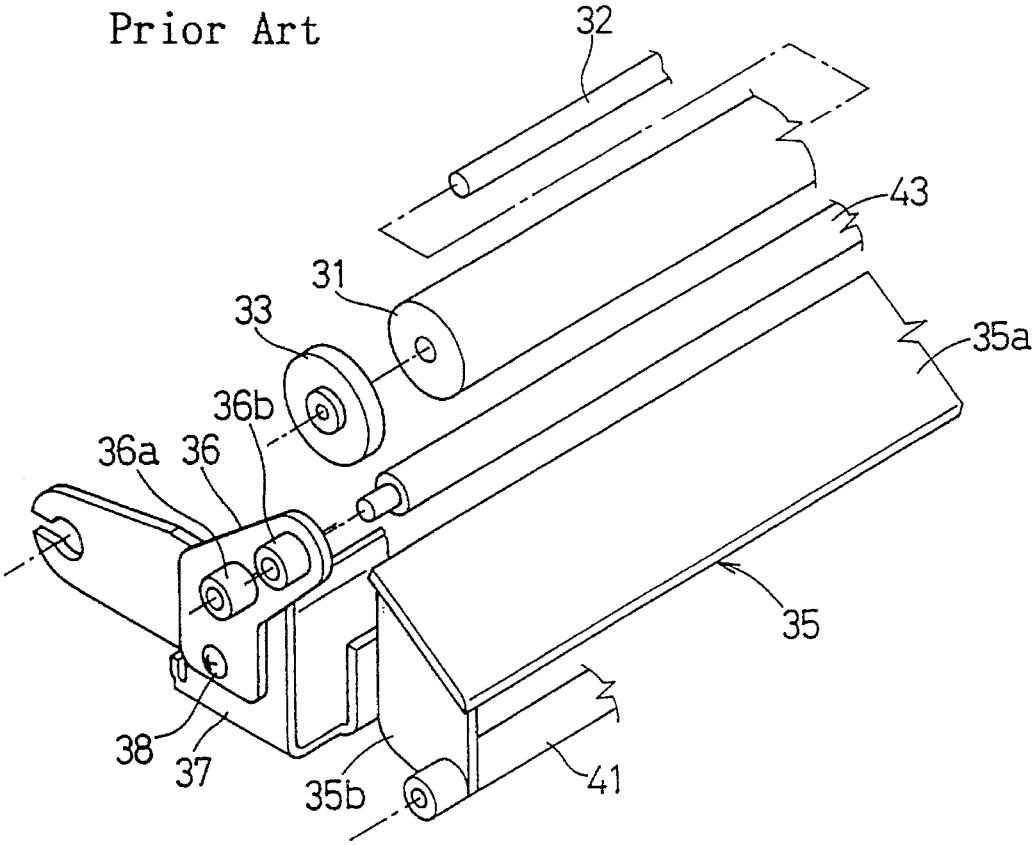
Fig. 2 Prior Art
FIG. 2 is an exploded perspective view of a relevant portion of the conventional transfer unit.
Figure 3:
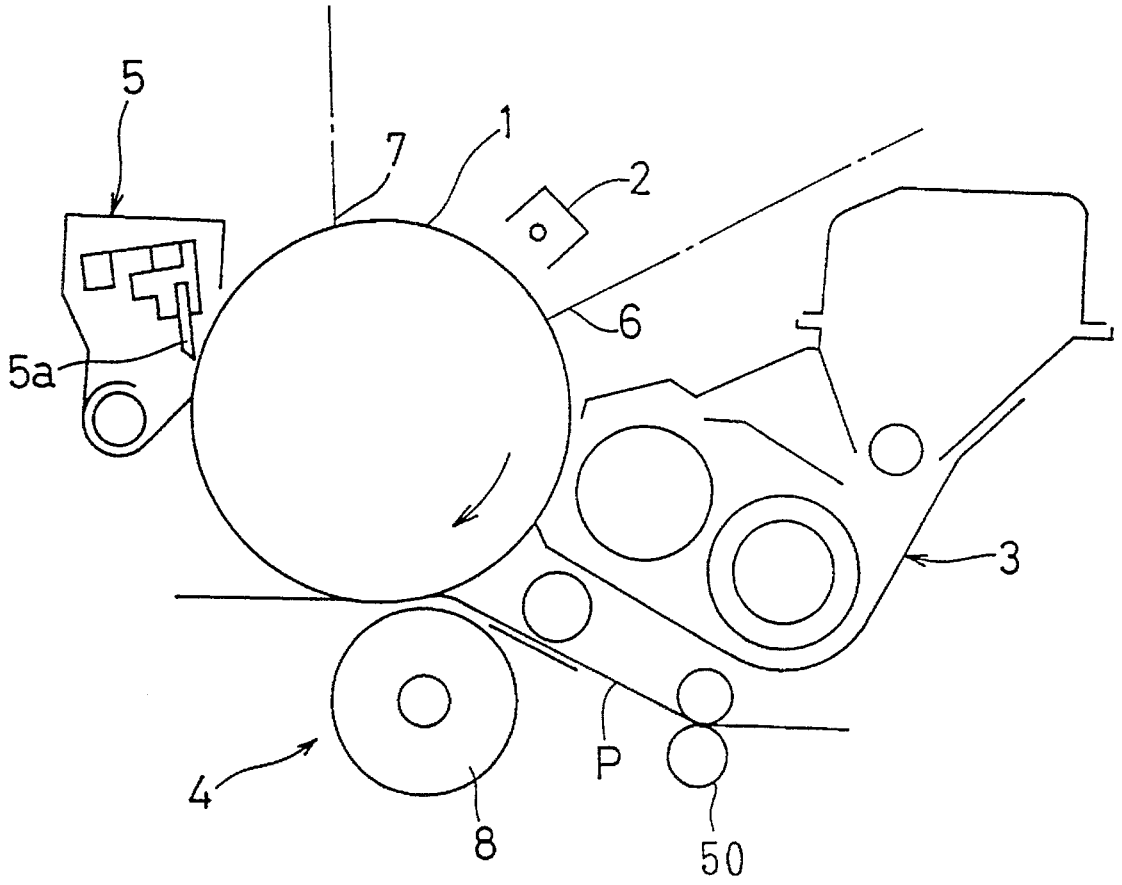
FIG. 3 is a cross-sectional view schematically showing the arrangement of a copying machine associated with a first embodiment of the present invention.

A first embodiment of the present invention where the present invention is employed in an electrophotographic copying machine will be described with reference to the drawings. Referring to FIG. 3, there is shown a schematic view of a relevant portion of the copying machine. Along the periphery of a photoreceptor drum 1, the following are provided in this order in the rotation direction of the drum 1: a main charger 2 including a corona discharger; a developer unit 3; a transfer unit 4; and a cleaning unit 5.

Between the main charger 2 and the developer unit 3, an exposure portion 6 is arranged, and between the cleaning unit 5 and the main charger 2, a charge removing portion 7 is arranged. Reference numeral 50 represents paper feeding rollers for feeding a sheet P to a gap between the drum 1 and the transfer unit 4 at a predetermined timing. The paper feeding rollers 50 are arranged at an end portion of a paper feeding unit (not shown).

In a copying machine provided with this structure, the surface of the photoreceptor drum 1 is charged by corona discharging of the main charger 2. On the charged drum surface, an electrostatic latent image of an original image read out by an optical system (not shown) provided in an upper part of the machine body is formed at the exposure portion 6. Then, by the developer unit 3, charged toner is attached to the electrostatic latent image to form a toner image of the original image. While the toner image is being formed, the sheet P is fed to the gap between the drum 1 and the transfer unit 4 at a predetermined timing by the paper feeding unit, and the transfer unit 4 operates in a subsequently-described manner to transfer the toner image on the drum surface onto the sheet P.

After the transfer, toner remaining on the drum surface is removed by a cleaning blade 5*a* provided in the cleaning unit 5, and the charge on the drum surface is removed at the charge removing portion 7, so that the drum surface is ready for the next charging. The sheet P on which the toner image has been transferred is heated and pressurized by a fixing unit (not shown) arranged on the downstream side of the transfer unit 4 in the machine body to thereby fix the toner image. Finally, the sheet P is discharged from the machine body.

Figure 4:
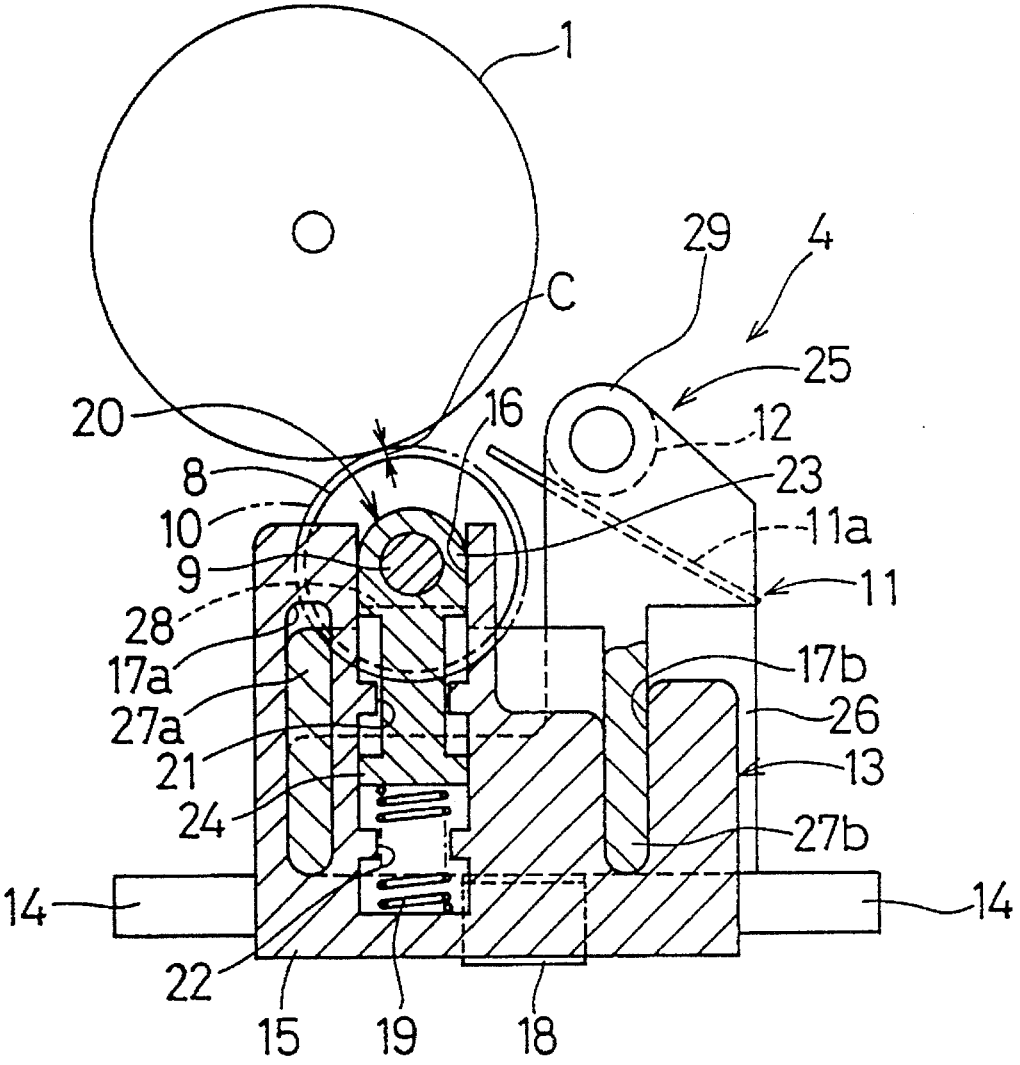
FIG. 4 is a longitudinal cross-sectional view of the transfer unit of the first embodiment.

Referring to FIG. 4, there is shown the specific arrangement of the transfer unit 4. Below the photoreceptor drum 1, a transfer roller 8 is arranged to be parallel to the photoreceptor drum 1. The transfer roller 8 includes an internal tube 8*a* made of, for example, a metallic material having an excellent conductivity such as copper, aluminum and iron or of a conductive resin material containing carbon, and an external tube 8*b* having an elastic tube such as a sponge tube and nesting the internal tube therein. The transfer roller 8 has a length to cover the image forming area on the drum surface.

At each end of the roller shaft 9 to which the transfer roller 8 is attached, gap maintaining rollers 10 having the same diameter which is slightly greater than that of the transfer roller 8 is rotatably attached. As described later, the peripheral surfaces of the gap maintaining rollers are elastically and rotatively in contact with the surface of the drum 1 so that a predetermined gap C is left between the transfer roller 8 and the drum surface. In this embodiment, the gap C is approximately 0.5 mm.

In the vicinity of the upstream side of the transfer roller 8, a pre-transfer guide 11 is arranged for guiding the sheet P to the drum surface. The pre-transfer guide 11 has a guide plate 11a which is longer along the width of the machine body. The guide plate 11*a* is arranged to be parallel to the photoreceptor drum 1 and to ascend from the upstream side to the downstream side along the sheet passage. Above the pre-transfer guide 11, a pre-transfer roller 12 is arranged so that a slight gap is left between the upper surface of the guide plate 11*a* and the pre-transfer roller 12. The pre-transfer roller 12 rotates in a direction corresponding to the rotation direction of the drum 1 to convey the sheet P at a speed equal to the peripheral speed of the drum 1. The pre-transfer roller 12 is rotated together with the transfer roller 8 by a driving force of a motor transmitted through a known driving force transmitting system including gears and clutches provided in the machine body.

In the transfer unit 4 of this embodiment having the above-described arrangement, the sheet P fed by the paper feeding unit at a predetermined timing is guided to the upper surface of the guide plate 11*a* of the pre-transfer guide 11, and abuts the surface of the photoreceptor drum 1. At this time, the movement speed of the sheet P is the same as that of the drum surface because of the working of the paper feeding rollers 50. The front end of the sheet P is directed toward the gap C between the transfer roller 8 and the drum 1 while abutting the drum surface. The sheet P bulges upward while being supported at its under surface by the front end of the guide plate 11*a*. For this reason, the upper surface of the sheet P comes in contact with the pre-transfer roller 12 and receives a conveying force also from the pre-transfer roller 12. By the conveying force, the sheet P moves at a speed equal to that of the drum surface after it is released from the paper feeding rollers 50. Further, since the sheet P is supported at its undersurface by the front end of the guide plate 11*a* and is pressed at its upper surface by the pre-transfer roller 12, the upper surface of the sheet P is in close contact with the surface of the photoreceptor drum 1 at the gap C because of the resiliency of the sheet P.

When the sheet P passes through the gap C between the transfer roller 8 and the drum 1, a voltage of a polarity reverse to that of the toner on the drum surface is applied to the transfer roller 8. Thereby, the toner image carried by the photoreceptor drum 1 on its surface is transferred onto the upper surface of the sheet P. After the transfer, the sheet P is separated from the drum surface and sent to the fixing unit as described previously.

While the pre-transfer roller 12 and the guide plate 18*a* of the pre-transfer guide 11 are out of contact with each other in this embodiment, the pre-transfer roller 12 may be arranged to be substantially in contact with the upper surface of the guide plate 11*a*.

Figure 5:
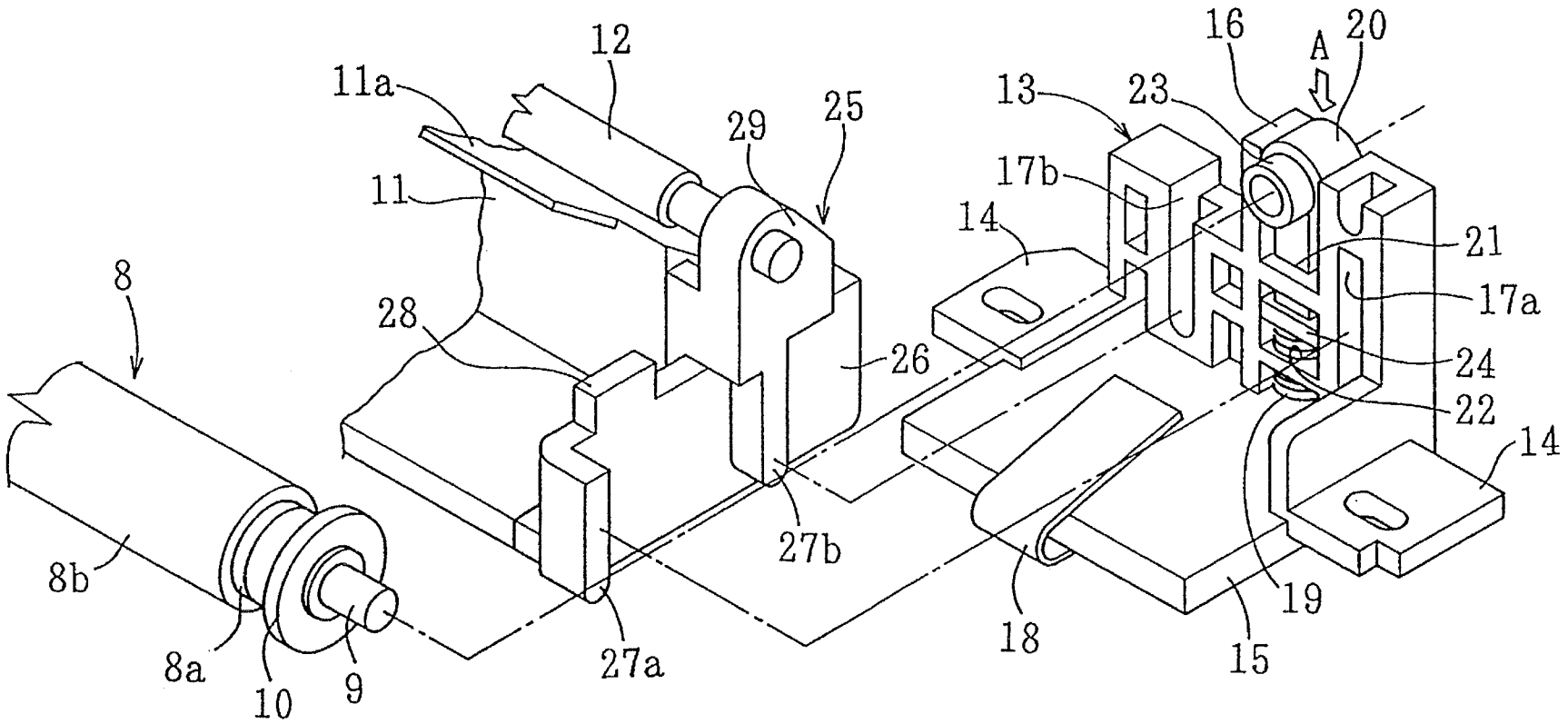
FIG. 5 is an exploded perspective view of a relevant portion of the transfer unit of the first embodiment.

In the transfer unit 4 of this embodiment, the transfer roller 8 and the pre-transfer guide 11 are supported independently at the front and at the rear. Referring to FIG. 5, there is shown an exploded perspective view of a front supporting structure. Reference numeral 13 represents a bearing attacher fixed by fixing brackets 14 provided at both sides to the base of the machine body by screws. The bearing attacher 13 is a resin mold of an L-shaped longitudinal cross section consisting of a base plate 15 and a bearing fitting portion 16 provided to protrude upward substantially in the center of the base end portion of the upper surface of the base plate 15. At the left and right ends of the bearing fitting portion 16, first and second guide grooves 17*a* and 17*b* parallel to each other and longer in the vertical direction are formed. At the front end of the base plate 15, a guide pushing spring 18 including a U-shaped plate spring serving as a guide pushing member is attached.

The bearing fitting portion 16 of the bearing attacher 13 is a longitudinal groove which is open at its upper end. At its bottom, a bearing pushing spring 19 including a coil spring serving as a bearing pushing member is provided. Above the bearing pushing spring 19, a bearing member 20 is inserted to be slidable upward and downward while being pushed up by the bearing pushing spring 19. Reference numeral 21 represents a bearing guiding hole provided in the middle of the height of the bearing fitting portion 16. Reference numeral 22 represents a hole provided below the bearing guiding hole for holding the posture of the bearing pushing spring 19.

The bearing member 20 is of a rod form having at its upper end a boss 23 supporting the transfer roller shaft 9 and having at its lower end a spring receiver for the bearing pushing spring 19. The boss 23 is formed to be of a short cylindrical form and protrudes toward the inside of the machine body. FIG. 5 shows the position of the bearing member 20 when the gap maintaining rollers 10 supported by the bearing members 20 through the roller shaft 9 are in contact with the drum 1. The bearing member 20 is slightly lowered as shown by the arrow A against the pushing force of the bearing pushing spring 19 by a reaction from the drum 1.

A guide attaching member 25 for supporting an end portion of the pre-transfer guide 11 engages with the bearing attacher 13. The guide attaching member 25 is a resin mold having a vertical wall 26 facing the bearing attacher 13. On the inner surface side of the vertical wall 26, an attachment portion of the pre-transfer guide 11 is provided. On the external surface of the wall 26 facing the bearing attacher 13, first and second slide protrusions 27*a* and 27*b* are formed. The widths of the slide protrusions 17*b* and 27*b* and the distance therebetween are set so that the protrusions 17*a* and 17*b* engage with the guide grooves 17*a* and 17*b* of the bearing attacher 13, respectively. On the upper surface of the vertical wall 26 in the middle of the first and second slide protrusions 27*a* and 27*b*, an engagement protrusion 28 is provided which abuts and engages with the undersurface of the boss 23 of the bearing member 20. The upward extension of the second slide protrusion 27*b* is formed to be a bracket 29 for rotatably supporting the both ends of the pre-transfer roller 12.

The guide attaching member 25 thus structured is fixed to each end of the pre-transfer guide 11 so that the slide protrusions 27*a* and 27*b* are arranged outside, and is attached onto the base plate 15 of the bearing attacher 13 with the first and second slide protrusions 27*a* and 27*b* being inserted into the first and second guide grooves 17*a* and 17*b* and with the upper surface of the engagement protrusion 28 abutting the undersurface of the boss 23.

Under this attachment condition, the guide attaching member 25 is pushed up by the guide pushing spring 18 and is guided slidably upward and downward by the engagement of the first and second slide protrusions 27*a* and 27*b* with the first and second guide groove 17*a* and 17*b*. In addition, by the abutment of the engagement protrusion 28 on the boss 23 of the bearing member 20, the position of the guide attaching member 25 can be varied with the vertical variation in position of the bearing member 20.

The arrangement of the rear supporting structure is substantially the same as the above-described arrangement of the front supporting structure. To the ends of the transfer roller shaft 9 and the shaft of the pre-transfer roller 12 protruding outward from the rear supporting structure, gears for rotating the transfer roller 8 and the pre-transfer roller 12 at a predetermined speed in accordance with the rotation of the photoreceptor drum 1 is attached, and gears for transmitting the driving force are provided in the rear supporting structure. However, these gears do not affect the support of the transfer roller 8 and the pre-transfer guide 11. In the rear supporting structure, the transfer roller 8 and the pre-transfer guide 11 are supported in the same manner as in the front supporting structure.

With the transfer roller 8 and pre-transfer guide 11 supporting structures of the above-described arrangements, since the positions of the bearing members 20 are independently changeable relative to the bearing attachers 13 fixed to the machine body owing to the pushing force of the bearing pushing springs 19, the front and rear gap maintaining rollers 10 are always in contact with the surface of the drum 1. As a result, even if the machine body is distorted to vary the position of the bearing attacher 13 relative to the photoreceptor drum 1, the gap C between the transfer roller 8 and the drum surface is maintained uniform and fixed along the roller shaft 9.

Further, since the engagement protrusion 28 abuts the boss 23 of the bearing member 20 whose distance from the drum 1 is maintained fixed, the front and rear guide attaching members 25 vertically slide to vary their positions independently of each other in response to the vertical position variation of the bearing members 20. For this reason, the position of the pretransfer guide 11 relative to the photoreceptor drum 1 is maintained fixed whether the machine body is distorted or not. As a result, The distance between the drum surface and the upper end of the guide plate 11*a* is always maintained uniform and fixed.

Figure 6:
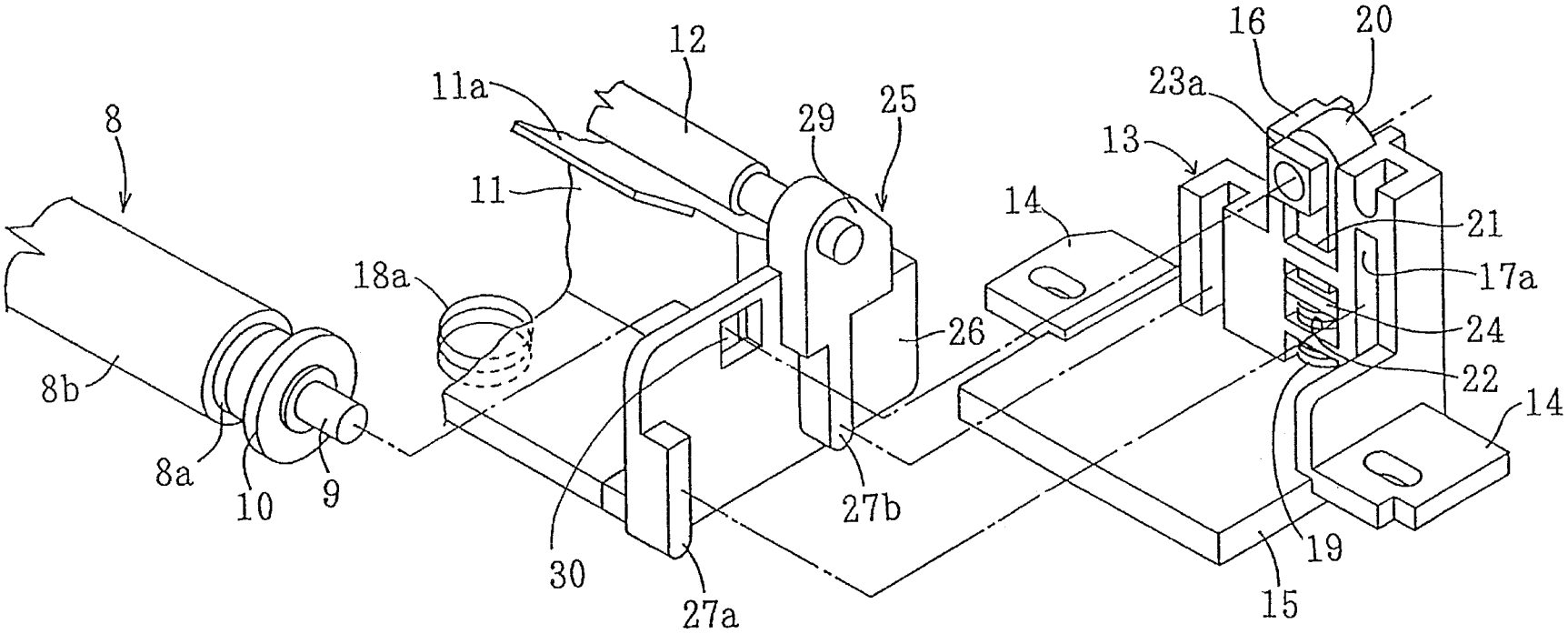
FIG. 6 is an exploded perspective view of a relevant portion of a transfer unit associated with a second embodiment of the present invention.

Referring to FIG. 6, there is shown a relevant portion of a transfer unit of the second embodiment of the present invention. In this embodiment, the transfer roller and the pretransfer guide are also supported independently at the front and at the rear. FIG. 6 shows a front supporting structure. The arrangement of the bearing attacher 13 of this embodiment is substantially the same as that of the bearing attacher 13 of the first embodiment, and only differences will be described.

A boss 23*a* provided at an upper portion of the bearing member 20 for supporting the transfer roller shaft 9 is a rectangular solid unlike the boss 23 of a short cylindrical form of the first embodiment. The vertical wall 26 of the guide attaching member 25 is formed to extend upward between the first and second slide protrusions 27*a* and 27*b*, and is provided with a rectangular opening 30 to be engaged with the boss 23*a*. Instead of the U-shaped plate spring 18 of the first embodiment, a compression coil spring 18*a* is used as the guide pushing member. The guide pushing spring 18*a* is provided between the bottom plate of the pre-transfer guide 11 and the base of the machine body for pushing up the pre-transfer guide 11.

The guide attaching member 25 and the bearing attacher 13 are assembled by inserting the first and second slide protrusions 27*a* and 27*b* into the first and second guide grooves 17*a* and 17*b* of the bearing attacher 13 and by engaging the boss 23*a* of the bearing member 20 fitted in the bearing guide hole 21 with the opening 30. At this time, since the four side surfaces of the rectangular boss 23*a* are in close contact with the inner surface of the opening 30, the bearing member 20 and the guide attaching member 25 are integrated.

The other portions of the supporting structures of this embodiment are the same as those of the supporting structures of the first embodiment. Subsequently, the operations of the supporting structures will be described.

The bearing member 20 and the guide attaching member 25 integrated by the engagement of the boss 23*a* with the opening 30 are pushed upward by the bearing pushing spring 19 and the guide pushing spring 18*a*, and are guided by the engagement of the slide protrusions 27*a* and 27*b* with the guide grooves 17*a* and 17*b*. At this time, the transfer roller shaft 9 supported by the bearing member 20 and the pre-transfer guide 11 fixed to the guide attaching member 25 move in the same manner. To the transfer roller shaft 9, the gap maintaining rollers 10 are attached outside the transfer roller 8, and when the gap maintaining rollers 10 abut the surface of the photoreceptor drum 1, the upward movements of the transfer roller 9 and the pre-transfer guide 11 are stopped. Thus, at the front side of the machine, the gap between the transfer roller 8 and the drum surface and the distance between the guide plate 11*a* of the pre-transfer guide 11 and the drum surface are maintained fixed.

The arrangement of the rear supporting structure is substantially the same as that of the front supporting structure, and by the same operation as that described above, the gap between the transfer roller 8 and the drum surface and the distance between the upper end of the guide plate 11*a* and the drum surface are maintained fixed at the rear side. Further, since the diameters of the front and rear gap maintaining rollers 10 are the same, the gap C between the transfer roller 8 and the photoreceptor drum 1 and the distance between the guide plate 11*a* and the photoreceptor drum 1 are uniform along the transfer roller shaft 9, i.e. along the width of the machine body.

In the rear supporting structure, like in the first embodiment, a driving force transmitting system including gears is arranged to rotate the transfer roller 8 and the pre-transfer roller 12 at a predetermined speed. However, this does not affect the support of the transfer roller 8 and the pre-transfer guide 11.

Thus, in this embodiment, the gap C between the transfer roller 8 and the photoreceptor drum 1 is maintained uniform and fixed by supporting the transfer roller shaft 9 independently at the front and at the rear, and the distance between the pretransfer guide 11 and the photoreceptor drum 1 is maintained uniform and fixed by integrally moving the pre-transfer guide 11 and the transfer roller shaft 9.

While in this embodiment, the guide pushing spring 18*a* is arranged between the bottom plate of the pre-transfer guide 11 and the base of the machine body, it may be arranged between the bottom plate of the pre-transfer guide 11 and the base plate 15 of the bearing attacher 13. Further, since the guide pushing spring 18*a* and the bearing pushing spring 19 are provided for pushing the bearing member 20 and the guide attaching member 25 which are integrated with each other, when one of them has a sufficient pushing force, the other is not always necessary. The members 20 and 25 may be pushed only by one of the springs 18*a* and 19.

According to the present invention, in any of the arrangements of the first and second embodiments, the gap between the transfer roller and the photoreceptor drum and the distance between the pre-transfer guide and the photoreceptor drum can always be maintained uniform and fixed. Since the gap between the transfer roller and the photoreceptor drum is uniform, the voltage applied to the sheet by the transfer roller is also uniform. Since the distance between the pre-transfer guide and the photoreceptor drum is uniform, the sheet is uniformly in contact with the photoreceptor drum. Consequently, even if the machine body is distorted for some reason, the efficiency of the toner transfer from the surface of the photoreceptor drum to the sheet is maintained uniform, so that the image can always be transferred excellently without any non-uniformity in toner density.

Obviously, many modifications and variations of the present invention are possible in light of the above teachings. It is therefore to be understood that within the scope of the appended claims, the invention may be practiced other than as specifically described.

What is claimed is:

1. A transfer unit comprising:

a transfer roller arranged below a photoreceptor drum, a gap maintaining roller having a diameter greater than a diameter of the transfer roller provided in a vicinity of each end of the transfer roller, the gap maintaining rollers being in contact with a surface of the photoreceptor drum to form a predetermined gap between a peripheral surface of the transfer roller and the surface of the photoreceptor drum, a pre-transfer guide for guiding a sheet to the photoreceptor drum arranged in a vicinity of an upstream side of the transfer roller, a bearing member for admitting therein an end portion of a roller shaft of the transfer roller, said bearing member being independently arranged in a vicinity of each end of the roller shaft, being arranged to be slidable upward and downward, and being elastically pushed up, such that said gap maintaining rollers are brought in contact with the surface of the photoreceptor drum, and a guide attaching member for attaching the end portion of the pre-transfer guide, the guide attaching member being arranged to be slidable upward and downward, being elastically pushed up, and being independently arranged in a vicinity of each end of the pre-transfer guide, the bearing member and the guide attaching member being engaged with each other so that a vertical position variation of the transfer roller and a vertical position variation of the end portion of the pre-transfer guide accord with each other.

2. A transfer unit according to claim 1, wherein in order that the vertical position variations of the transfer roller and the end portion of the pre-transfer guide accord with each other, an upper surface of the guide attaching member always abuts a part of the bearing member while the guide attaching member is elastically pushed up.

3. A transfer unit according to claim 1, wherein in order that the vertical position variations of the transfer roller and the end portion of the pre-transfer guide accord with each other, the guide attaching member and the bearing member are engaged with each other through a boss and an opening so that the guide attaching member and the bearing member are integrated with each other.

4. A transfer unit according to claim 1, wherein at the both ends of the roller shaft, the bearing member is supported while being elastically pushed, the guide attaching member is attached to be slidable upward and downward while being elastically pushed up, and a pair of bearing attachers fixed to a body of the apparatus is provided.

* * * * *